US009931738B2

(12) United States Patent
Greco et al.

(10) Patent No.: US 9,931,738 B2
(45) Date of Patent: Apr. 3, 2018

(54) SPECIAL TOOL FOR JEEP MOUNTING KNOB SCREW

(71) Applicants: Dennis Greco, Glenview, IL (US); David Jacobs, South Barrington, IL (US)

(72) Inventors: Dennis Greco, Glenview, IL (US); David Jacobs, South Barrington, IL (US)

( * ) Notice: Subject to any disclaimer, the term of this patent is extended or adjusted under 35 U.S.C. 154(b) by 413 days.

(21) Appl. No.: 14/723,668

(22) Filed: May 28, 2015

(65) Prior Publication Data

US 2016/0016295 A1 Jan. 21, 2016

Related U.S. Application Data

(60) Provisional application No. 62/005,316, filed on May 30, 2014.

(51) Int. Cl.
*B25B 13/50* (2006.01)
*B25B 27/00* (2006.01)

(52) U.S. Cl.
CPC ..... *B25B 13/50* (2013.01); *B25B 27/0035* (2013.01)

(58) Field of Classification Search
CPC ..... B25B 13/50; B25B 27/0035; B25B 13/04; B25B 13/06; B25B 13/48; B25B 13/065; B25B 13/481; B25B 13/08
See application file for complete search history.

(56) References Cited

U.S. PATENT DOCUMENTS

| | | | | |
|---|---|---|---|---|
| 2,668,466 | A * | 2/1954 | Schofield | B25B 13/48 81/176.15 |
| 3,733,938 | A * | 5/1973 | Smith | B25B 13/48 81/119 |
| 4,125,913 | A * | 11/1978 | Lewis | B25B 13/48 7/138 |
| 4,237,754 | A * | 12/1980 | Battrick | B25B 13/02 81/436 |
| 4,237,755 | A * | 12/1980 | Gunnell, III | B25B 13/48 81/176.15 |
| 5,957,011 | A * | 9/1999 | Thompson | B25B 13/02 81/176.15 |
| D426,438 | S * | 6/2000 | Ciok | D8/29 |
| 6,477,924 | B1 * | 11/2002 | Talbot | B25B 13/02 81/124.2 |
| 6,564,679 | B1 * | 5/2003 | Llamas | B25B 13/02 81/124.2 |

(Continued)

*Primary Examiner* — David B Thomas
(74) *Attorney, Agent, or Firm* — Clifford H. Kraft

(57) ABSTRACT

A special tool that can engage and manipulate a Jeep mounting screw commonly known as "Jeep Wrangler Hardtop Freedom Top Targa Mounting Knob Screw" Embodiments may include a handle that can contain indentations or ribs totally or partially extending its length for better grip. The handle abuts a flat head. A pair of screw engagement members are mounted on the flat head, separated, and spaced apart a pre-determined distance. The center region between the engagement members can be part of the flat head. Each engagement member is arc-shaped, or semi-circular in cross-section to fit into the knob screw head. The two engagement members are typically mounted in opposition and each extends approximately ⅓ the circumference of the head. This arrangement allows perfect engagement with the Jeep mount screw.

17 Claims, 2 Drawing Sheets

(56) References Cited

U.S. PATENT DOCUMENTS

| | | | | |
|---|---|---|---|---|
| D557,088 | S * | 12/2007 | Morgan | D8/29 |
| 7,802,499 | B2 * | 9/2010 | Stephens | B25B 13/065 81/124.2 |
| 8,701,526 | B2 * | 4/2014 | Scott | B25B 13/065 29/426.5 |
| 8,826,780 | B1 * | 9/2014 | Alho | B25B 13/06 81/124.2 |
| 2004/0050218 | A1 * | 3/2004 | Napoli | B25B 13/48 81/176.2 |
| 2004/0255727 | A1 * | 12/2004 | Kovach | B25B 13/02 81/176.15 |
| 2005/0050632 | A1 * | 3/2005 | Leatherby | B25B 13/48 4/695 |
| 2007/0180611 | A1 * | 8/2007 | Rhoda | B25B 13/48 4/661 |

* cited by examiner

SPECIAL TOOL FOR JEEP MOUNTING KNOB SCREW

This application is related to and claims priority from U.S. Provisional Application 62/005,316 filed May 30, 2014. Application 62/005,316 is hereby incorporated by reference in its entirety.

BACKGROUND

Field of the Invention

The present invention relates generally to hand tools for manipulating screws and more particularly to a special tool that fits a jeep mounting knob screw.

Description of the Prior Art

Numerous hand tools used for fitting and manipulating various types of screws and fasteners are known in the art. However, JEEP® vehicles are manufactured with a special type of mounting knob screw used to secure a removable modular roof commonly known as a FREEDOM TOP®. The fastener typically holds the rooftop to the roll bar by insertion into a threaded part in the roof panel. These mounting knob screws have a particularly shaped head that is virtually impossible to engage with standard hand tools such as screwdrivers and the like. These mounting knob screws are typically tightened and loosened by hand which, by reason of the location and fastener head design, are very difficult to (yip or engage with a standard tool. In fact, the fastener head is smooth and round, and located in areas where it is very difficult to obtain a good hand grip or allow for good leverage to tighten or loosen the screw.

It would be advantageous to have a special hand tool that is designed to mate with and interface a Jeep mounting knob screw for easy installation, removal, tightening or loosening regardless of where it is located.

SUMMARY OF THE INVENTION

The present invention relates to a special tool that can engage and manipulate a JEEP® mounting screw commonly known as "JEEP WRANGLER® HARDTOP FREEDOM TOP® TARGA Mounting Knob Screw". Embodiments may include a handle that can contain indentations or ribs totally or partially extending its length for better grip. The handle may also be in the form of a crank, a wrench handle or a wrench handle with a ratchet. Any handle is within the scope of the present invention. The handle abuts a flat head. A pair of screw engagement members are mounted on the flat head, separated, and spaced apart a pre-determined distance. The center region between the engagement members can be part of the flat head. Each engagement member is arc-shaped, or semi-circular in cross-section to fit into the knob screw head. The two engagement members are typically mounted in opposition and each extends approximately ⅓ the circumference of the head. This arrangement allows perfect engagement with the JEEP® mount screw.

DESCRIPTION OF THE FIGURES

Attention is directed to several figures that illustrate features of the present invention.

Several drawings and illustrations have been presented to aid in understanding the present invention. The scope of the present invention is not limited to what is shown in the figures.

DESCRIPTION OF THE PREFERRED EMBODIMENTS

Figure 1:
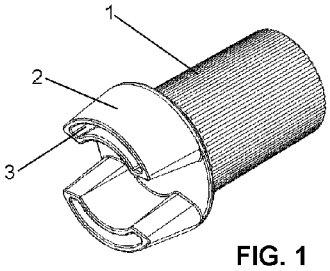
FIG. 1 shows a perspective view of an embodiment of the tool of the present invention.

The present invention relates to a special tool that can engage and manipulate a JEEP® mounting screw commonly known as "JEEP WRANGLER® HARDTOP FREEDOM TOP® TARGA Mounting Knob Screw". FIG. 1 shows an embodiment of the present invention including a handle 1 that may contain indentations or ribs totally or partially extending its length for better grip. The handle may also be in the form of a crank, a wrench handle or a wrench handle with a ratchet. Any handle is within the scope of the present invention. The handle 1 abuts a flat head. A pair of screw engagement members 2 are mounted on the flat head, separated, and spaced apart a pre-determined distance. The center region 4 between the engagement members can be part of the flat head. The engagement members should be thick enough to avoid cracking or breaking during use. FIG. 1 shows the engagement members with slots 3; however, these slots are not necessary for the functioning of the present invention. They can be used to improve the cooling process during manufacture, since the preferred material for the present invention is plastic. While plastic is preferred, the special tool of the present invention can be made from any rigid material including metal.

Each engagement member 2 is typically arc-shaped, or semi-circular in cross-section to fit into the knob screw head. The two engagement members 2 are typically mounted in opposition and each extends approximately ⅓ the circumference of the head. This arrangement allows perfect engagement with the Jeep mount screw.

Figure 2:
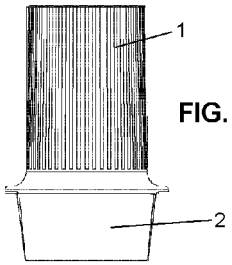
FIG. 2 shows a side view of the tool.

FIG. 2 shows a side view of the tool.

Figure 3A:
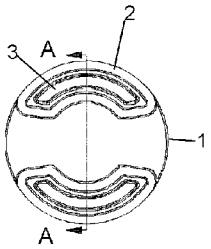
FIG. 3A shows a front end view of the front end of tool with a section line.
Figure 3B:
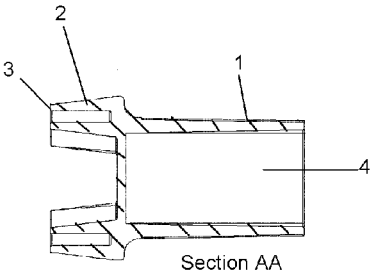
FIG. 3B is a sectional view of the tool along the section line shown in FIG. 3A.

FIG. 3A shows a front end view of the tool with a section line A-A. The engagement members 2 and the slot 3 are clearly seen. FIG. 3B shows a cross section of the tool along section line A-A from FIG. 3A. The inside space in the handle 4 can be empty or filled. The tops of the engagement members 2 can be seen curve slightly inward toward the centerline, while their bottoms curve lightly outward from the centerline. Again, the slots 3 in the engagement members 2 are optional.

Figure 4:
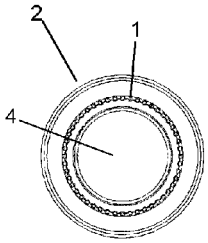
FIG. 4 shows a rear end view of the tool.

FIG. 4 shows a rear end view of the tool. The handle 1 can be clearly seen. The space 4 inside the handle may be empty or filled as stated. If it is empty, it can be optionally closed with a thin cover.

Figure 5:
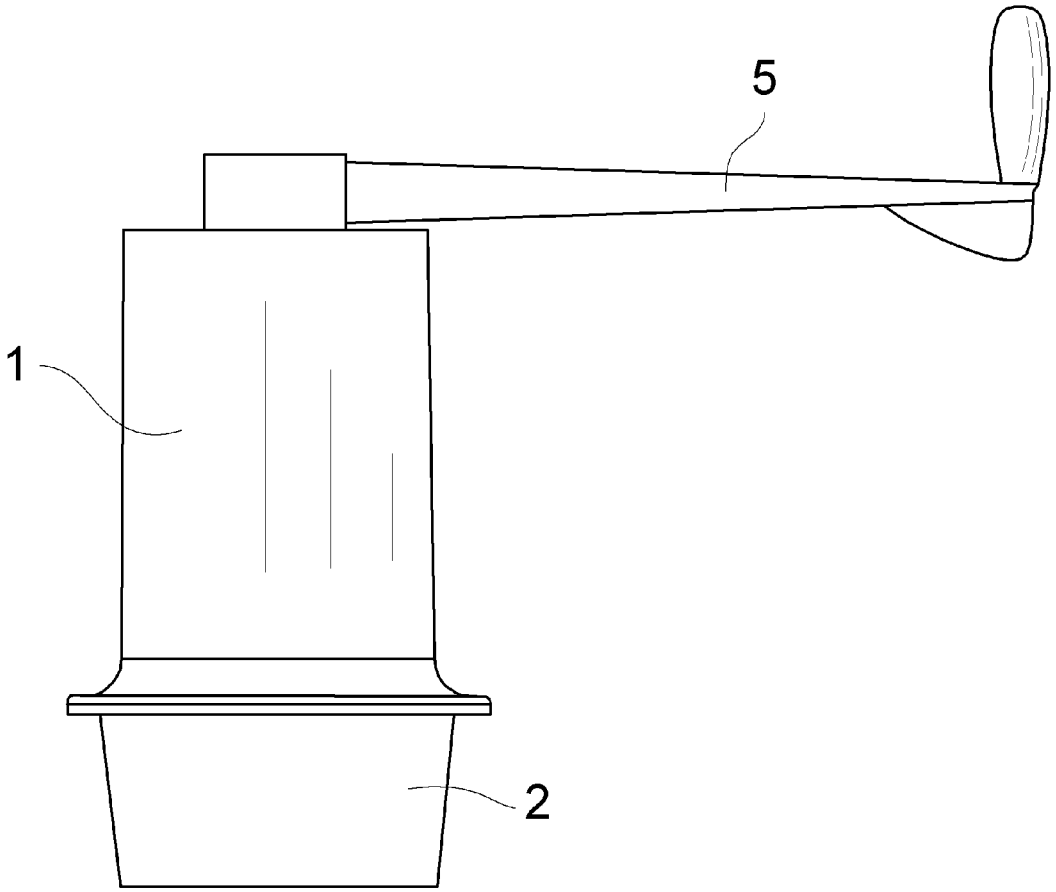
FIG. 5 shows an embodiment of the present invention with a crank handle.

FIG. 5 shows an embodiment of the present invention with a crank handle (5).

Several descriptions and illustrations have been presented to aid in understanding the present invention. One with skill in the art will realize that numerous changes and variations may be made without departing from the spirit of the invention. Each of these changes and variations is within the scope of the present invention.

We claim:

1. A hand tool for manipulation of JEEP WRANGLER® HARDTOP FREEDOM TOP® TARGA Mounting Knob Screws comprising:

an elongated cylindrical handle;

a circular flat head;

a pair of engagement members attached in opposition on said circular flat head, each of said engagement members being arc-shaped extending approximately one-third the circumference of the flat head and protruding from said flat head, the engagement members sized to mate with a TARGA mounting knob screw;

wherein each of the engagement members includes an internal slot.

2. The hand tool of claim 1 wherein said handle has a plurality of longitudinal ribs forming a grip.

3. The hand tool of claim 1 wherein the elongated handle is hollow.

4. A tool apparatus comprising:

a tool body including an engaging portion and a handle portion;

the engaging portion including a plurality of engagement members, the segments being separated and spaced apart a predetermined distance, the segments extending outwardly of the handle portion;

wherein each of the engagement members includes an internal slot.

5. The apparatus of claim 4 wherein the engaging portion has two engagement members.

6. The apparatus of claim 5 wherein the predetermined distance is approximately ⅙ of the circumference of the engaging portion.

7. The apparatus of claim 4, wherein the engaging portion includes two engagement members having a semi circular configuration in cross-section.

8. The apparatus of claim 4 wherein the handle portion includes an elongated substantially cylindrical handle.

9. The apparatus of claim 8 wherein the handle includes a plurality of ridges adapted to improve grip.

10. The apparatus of claim 4 wherein the handle portion includes a crank.

11. The apparatus of claim 4 wherein the handle portion includes a wrench handle.

12. The apparatus of claim 11 wherein in the wrench handle has a ratchet.

13. A tool apparatus comprising:

a tool body including an engaging portion and a handle portion;

the handle portion being elongate along a longitudinal axis;

the engaging portion including two engagement members that extend outwardly from the handle portion, the engagement members being disposed around the longitudinal axis and spaced apart a predetermined distance, the engagement members having a semi-circular configuration in cross-section;

wherein each of the engagement members includes an internal slot.

14. The tool apparatus of claim 13 wherein the handle portion is an elongated cylinder.

15. The tool apparatus of claim 14 wherein the handle portion includes a plurality of indented segments adapted to improve grip.

16. The tool apparatus of claim 13 wherein the handle portion includes a plurality of indented segments adapted to improve grip.

17. The tool apparatus of claim 13 wherein the handle portion is hollow.

* * * * *